United States Patent [19]

Nohira et al.

[11] 4,069,797

[45] Jan. 24, 1978

[54] APPARATUS FOR RECIRCULATING EXHAUST GASES

[75] Inventors: Hidetaka Nohira; Masaaki Tanaka, both of Susono, Japan

[73] Assignee: Toyota Jidosha Kogyo Kabushiki Kaisha, Toyota, Japan

[21] Appl. No.: 669,267

[22] Filed: Mar. 22, 1976

[30] Foreign Application Priority Data

June 24, 1975 Japan ..... 50-078039

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,762,384 | 10/1973 | Day | 123/119 A |
| 3,814,070 | 6/1974 | Wentheimen | 123/119 A |
| 3,901,202 | 8/1975 | Hollis | 123/119 A |

*Primary Examiner*—Carlton R. Croyle
*Assistant Examiner*—L. J. Casaregola
*Attorney, Agent, or Firm*—Blanchard, Flynn, Thieh, Boutell & Tanis

[57] ABSTRACT

An apparatus for recirculating exhaust gases, wherein an exhaust gas recirculating passage provides communication between the intake and exhaust passages of an internal combustion engine. A constriction is provided in the passage, and a control valve is provided in the passage downstream of the constriction. A negative control pressure passage introduces a negative control pressure from a port in the intake passage to the control valve. A pressure chamber is interposed between the constriction and the control valve, which pressure chamber has a pressure therein which is substantially equal to atmospheric pressure when the control valve is opened and to that in the exhaust passage when the control valve is closed. A first operating valve opens the negative control pressure passage to the atmosphere when the pressure in the pressure chamber becomes substantially atmospheric. A second operating valve, which is responsive to the amount of sucked air flowing through the intake passage, opens the negative control pressure passage to the atmosphere when the pressure in the intake passage exceeds a predetermined negative pressure.

8 Claims, 4 Drawing Figures

APPARATUS FOR RECIRCULATING EXHAUST GASES

FIELD OF THE INVENTION

This invention relates to an exhaust gas recirculating apparatus that decreases the amount of nitrogen oxides present in the exhaust gas of an internal combustion engine by introducing part of the exhaust gas into intake air which is supplied to the engine.

BACKGROUND OF THE INVENTION

Of the noxious substances (such as hydrocarbons, carbon monoxide, and nitrogen oxides) contained in exhaust gases from an internal combustion engine, nitrogen oxides are said to be formed by the reaction of nitrogen ($N_2$) with oxygen ($O_2$), which are present in the intake air, at high termperature. Therefore, the presence of nitrogen oxides in the exhaust gas can be reduced by avoiding combusting the air-fuel mixture at high temperature. This avoidance of high-temperature combustion is attained by increasing the ratio of inert gas in the intake air. For this purpose, an exhaust gas recirculating system (hereinafter abbreviated the EGR system) which supplies the exhaust gas into the intake air is employed.

However, EGR is likely to lead to unstable combustion in the cylinders and consequently to misfire. Accordingly, when to permit EGR and when to cut if off becomes an important problem. Generally speaking, ignitability is low during idling, even without EGR. If EGR were permitted, ignitability would be further impaired, and a large quantity of hydrocarbons would be emitted, which is undesirable from the viewpoint of emission control. Thus, EGR is usually cut off during this period. EGR is also cut off during full-load operation, because this period necessitates generation of maximum output, and does not last very long. Further, during deceleration, when ignitability is lower than during idling, EGR is usually cut off to prevent further worsening of ignitability. It has also been proposed to cut off EGR during starting and when operating the engine at low temperature.

In order to perform the above-described function, the conventional EGR system has included an EGR control valve, of diaphragm type, provided in the EGR passage interconnecting the intake and exhaust passages, which valve is operated by a negative pressure. The negative pressure working on a vacuum port in the intake passage is introduced into the actuation chamber of the EGR control valve, and said valve is actuated when the negative pressure exceeds a predetermined level so as to mix the recirculated exhaust gas into intake air. Said vacuum port is disposed so as to be located upstream and downstream of the edge of a throttle valve provided in the intake passage when it closes and opens, respectively. This vacuum port is usually provided in the vicinity of the edge of the throttle valve so that it becomes located upstream of said edge when the throttle valve is in the idling position, and downstream thereof when the throttle valve moves out of the idling position. Because of this construction, the conventional EGR system cuts off EGR only when the throttle valve is in the idling position, i.e., during the idling and deceleration of the engine, and when the throttle valve is substantially fully opened to make the pressure working on the vacuum port substantially atmospheric, i.e., during the full-load operation of the engine.

However, the recent tendency is to increase the quantity of the recirculated exhaust gas introduced into the intake so as to reduce the nitrogen oxides more effectively. In so doing, however, the temperature of the recirculated exhaust gas exceeds the heat-resisting limit of the EGR control valve in the high-speed, high-load operating condition, which is likely to give rise to burning and/or sticking of said valve and other troubles. It therefore becomes necessary to also cut off EGR in such an operating condition.

The primary object of this invention is to provide an EGR system that cuts off EGR not only during the idling, deceleration and full-load operations, but also in the partially laoded region if the quantity of air sucked is large, and, further, proportions the quantity of the recirculated exhaust gas to that of sucked intake air.

The feature of this invention lies in an EGR system that comprises, in combination, a constricted portion provided in an EGR passage interconnecting the intake and exhaust passages of an internal combustion engine, an EGR control valve provided downstream thereof, a negative control pressure passage introducing the negative control pressure from a vacuum port in the intake passage to said EGR control valve, a constant-pressure chamber located between said constricted portion and said EGR control valve so that the pressure inside lowers to atmospheric when the EGR control valve opens, since said chamber communicates with the intake passage, and becomes equal to the pressure in the exhaust passage when said valve closes, a first operating valve opening said negative control pressure passage to the atmosphere when the pressure in said constant-pressure chamber becomes substantially atmospheric, and a second operating valve opening said negative control pressure passage to the atmosphere when the pressure in the intake passage, which indicates the amount of intake air flowing therethrough, exceeds a predetermined negative pressure level, and further including means for detecting such factors as water temperature, drive speed and gear shifting for indicating the operating condition of an engine, and opening said negative control pressure passage to the atmosphere when the detected operating condition reaches a predetermined condition, when necessary.

DETAILED DESCRIPTION

Figure 1:
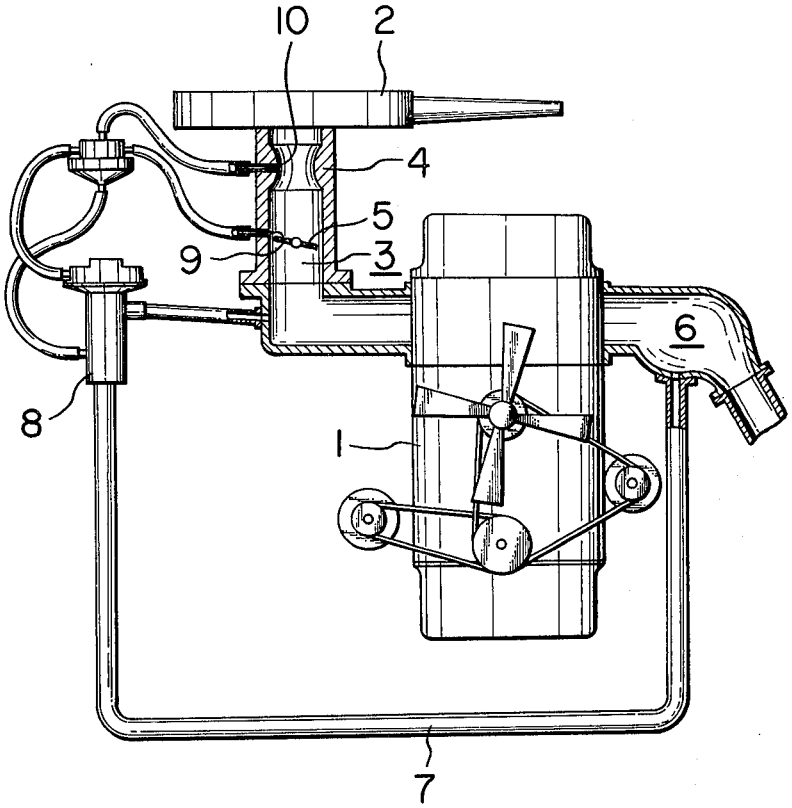
FIG. 1 is a schematic system diagram of an EGR apparatus according to this invention.

The construction of an EGR apparatus according to this invention will be described with reference to FIGS. 1 and 2.

Air is filtered and sucked through an air cleaner 2 into an engine 1, mixed with fuel in a carburetor 4 provided in an intake passage 3, and supplied into cylinders, not shown, with its quantity controlled by a throttle valve 5, where it is combusted to produce output. The combusted gas is exhausted to an exhaust passage 6. An EGR passage 7 is provided between the exhaust passage 6 and the intake passage 3, which supplies the exhaust gas to the intake passage 3 and cuts off such supply as it is opened and closed by an EGR control valve 8, respectively.

A vacuum port 9 and a venturi port 10 open into the intake passage 3, from which the negative pressure for controlling the operation of said EGR control valve 8 is obtained. The vacuum port 9 opens in the wall of the intake passage 3 in the vicinity of the edge of the throttle valve 5. When the throttle valve 5 is in the idling position, as shown, the vacuum port 9 is located upstream of the edge of the throttle valve 5 so that port 9 is exposed to substantially atmospheric pressure. When the throttle valve 5 opens to a partially loaded condition, port 9 becomes located downstream of the edge of the throttle valve 5 and is exposed to a pressure equal to the negative pressure in the intake passage 3. Further, when the throttle valve 5 fully opens to the full-load condition, the pressure working on the vacuum port 9 becomes substantially atmospheric since the throttling valve 5 performs no throttling function. The ventui port 10 is exposed to a negative pressure that increases with an increase in the quantity of sucked air; that is, the negative pressure detected at the venturi port 10 is proportioned to approximately the square of the quantity of sucked air.

Figure 2:
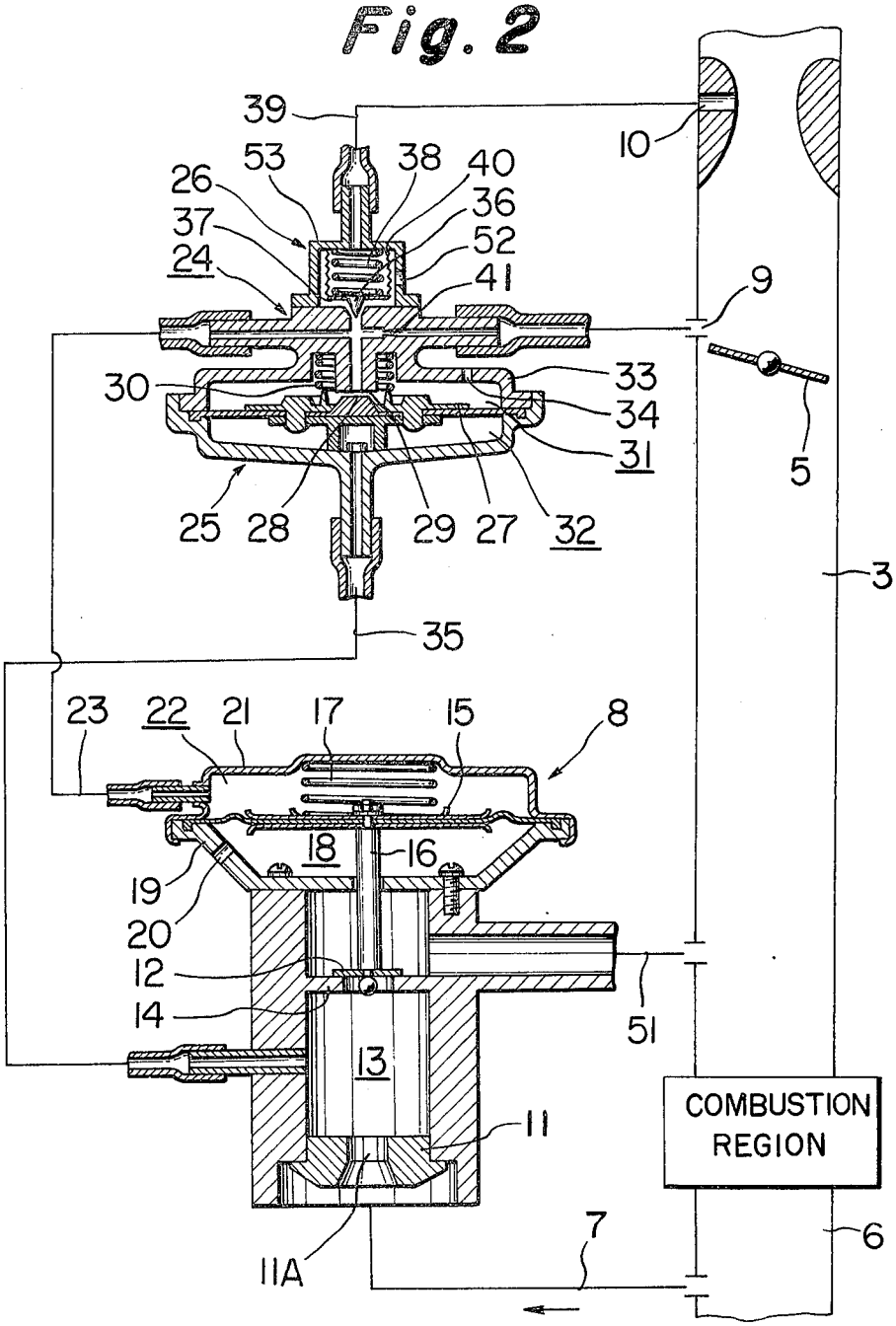
FIG. 2 is a cross-sectional view showing an embodiment of the mechanism for actuating the EGR control valve shown in FIG. 1.

The EGR control valve 8, as shown in FIG. 2, is placed at an intermediate point in the EGR passage 7. Control valve 8 has therein a constricted portion 11 defining an orifice 11A and an EGR control valve disc 12, with a constant-pressure chamber 13 therebetween, as provided in that order from upstream to downstream of the EGR flow. The orifice 11A has the smallest cross-sectional area throughout the entire EGR passage 7. The pressure in the constant-pressure chamber 13 is thus equal to the pressure in the exhaust passage 6 when the EGR control valve disc 12 is in contact with a valve seat 14 so as to close the EGR passage 7. The pressure in chamber 13 becomes substantially atmospheric when said valve disc 12 is moved away from the valve seat 14 so as to open the EGR passage 7.

The valve disc 12 is fixed to a rod 16 fastened to a diaphragm 15, and is urged in a closing direction by a spring 17. An actuation chamber 18 on one side of the diaphragm 15 consists of a space enclosed by said diaphragm 15 and a lower casing 19, which space 18 is opened to the atmosphere through a small opening 20. Another actuation chamber 22, defined by the diaphragm 15 and an upper casing 21, communicates with the vacuum port 9 through a negative control pressure passage 23. The EGR control valve 8 is actuated by moving the EGR control valve disc 12 by means of the negative pressure from the vacuum port 9, which is permitted by suitably adjusting or selecting the elasticity of the spring 17.

A pressure regulating valve assembly 24 is provided in the negative control pressure passage 23 to control the negative pressure working on the actuation chamber 22. The pressure regulating valve assembly 24 comprises a first working valve 25 and a second negative-pressure working valve 26. The first working valve 25 comprises a spring 30 that urges a valve disc 28, which is formed on a diaphragm 27, in the direction in which it is spaced from a valve seat 29. Two actuation chambers 31 and 32 are formed opposite to each other with the diaphragm 27 therebetween. The actuation chamber 31 is defined by the diaphragm 27 and an upper casing 33, contains said valve disc 28 and valve seat 29, and communicates with the atmosphere through a small opening 34. The actuation chamber 32 communicates with the constant-pressure chamber 13 through a passage 35.

The spring 30 is so adjusted as to (1) move the valve disc 28 away from the valve seat 29 to open the negative control pressure passage 23 to the atmosphere through the actuation chamber 31 and the small opening 34 when the pressure in the constant-pressure chamber 13 falls below a predetermined level, and to (2) cut off the negative control pressure passage 23 from the atmosphere when said pressure working on the actuation chamber 32 becomes high enough to overcome the downward force exerted by the spring 30.

The second negative-pressure working valve 26 comprises a spring 38 that urges a needle valve 36 into a valve seat 37, and a bellows 40 that holds said needle valve 36 and whose interior communicates with the venturi port 10 by a passage 39. The elasticity of the spring 38 is so selected as to move the needle valve 36 away from the valve seat 37 to open the negative control pressure passage 23 to the atmosphere through an opening 52 formed in casing 53 when the negative pressure at the venturi port 10 reaches a suitable value. A contraction 41 is provided in the negative control pressure passage 23 at a point which is closer to the vacuum port 9 than the portion that is opened to the atmosphere by said valve disc 28 and the needle valve 36.

OPERATION

When the engine 1 is at a standstill, the EGR control valve disc 12 and the needle valve 36 are both closed, while the valve disc 28 is opened. Even when the engine 1 starts and is in the idling condition, the negative pressure working on the venturi port 10 is small since the amount of sucked air is very small. Therefore, the pressure in the bellows 40 is high, and the needle valve 36 remains against the valve seat 37. Also, the pressure working on the vacuum port 9 is substantially atmospheric because the throttle valve 5 is not opened. This approximate atmospheric pressure is introduced through the negative control pressure passage 23 into the actuation chamber 22, as a consequence of which the EGR control valve disc 12 is urged by the spring 17 in a closing direction. Because said EGR control valve disc 12 is closed, the pressure inside the constant-pressure chamber 13 is substantially equal to the pressure in the exhaust passage 6. On being introduced through the passage 35 into the actuationchamber 32, this pressure urges the valve disc 28 against the valve seat 29, in opposition to the urging of the spring 30. Thus, during idling, the system operates as described above to eventually cut off EGR (exhaust gas recirculation).

Next, the case in which the engine transfers from the idling condition to the partially loaded condition will be described.

When the engine is partially loaded and not rotating at high speed, the quantity of sucked air is still relatively small, so that the negative pressure working on the venturi port 10 is not very high. Thus, the negative pressure from the venturi port 10 is not high enough to open the needle valve 36 against the force of the spring 38. On the other hand, due to the edge of the throttle plate passing over port 9, the negative pressure working on the vacuum port 9 is high enough so that, upon being introduced through the negative control pressure passage 23 into the actuation chamber 22, it opens the EGR control valve disc 12 against the force of spring 17 to permit EGR. The exhaust gas thus flows from chamber 13 through the opened valve 12 and through passage 51 into intake passage 3. With the start of EGR, the pressure in the constant-pressure chamber 13 drops. This reduced pressure is introduced through the passage 35 into the actuation chamber 32, whereupon spring 30 is able to move the valve disc 28 away from the valve seat 29. As a result, the small opening 34, the actuation chamber 31, the negative control pressure passage 23 and the actuation chamber 22 communicate with each other, thereby making the pressure in said actuation chamber 22 atmospheric. Then, the urging force of the spring 17 moves the valve disc 12 toward the valve seat 14 to reduce the exhaust gas recirculation. When the EGR is reduced, the pressure inside the constant-pressure chamber 13 rises to a level a little higher than the urging force of the spring 30. This higher pressure is introduced through the passage 35 into the actuation chamber 32 where it urges the valve disc 28 into engagement with the valve seat 29. Consequently, the pressure introduced through the passage 23 into the actuation chamber 22 is again made equal to the negative pressure prevailing at the vacuum port 9. The above-described cycle is repeated; that is, the EGR control valve disc 12 repeatedly opens and closes to permit intermittent EGR. Thus, the actuation of the first working valve 25 to open to the atmosphere or to produce the operating negative pressure in the vacuum chamber 22 depends on the pressure pulsation of the exhaust gas. The higher the pressure of the exhaust gas, the greater will be the extent to which the EGR control valve 12 opens. Since the amount of exhaust gas is proportional to that of sucked air, an increase in the latter results in an increase in the amount of recirculated exhaust gas.

As the engine proceeds to the high-load, high-speed operation, the quantity of sucked air flowing through the intake passage 3 increases, and the negative pressure working on the venturi port 10 becomes relatively high and is introduced through the passage 39 into the bellows 40. This higher pressure moves the needle valve 36 away from the valve seat 37 against the urging force of the spring 38, thus opening the negative control pressure passage 23 to the atmosphere through the opening 52. Therefore, irrespective of other conditions, the pressure inside the actuation chamber 22 becomes atmospheric. Thus, the EGR control valve disc 12 is urged against the valve seat 14 by the force of the spring 17, and EGR is cut off.

The operation of the system during deceleration will not be described because it is similar to the above-described operation during idling.

As understood from the above description, this invention permits the quantity of recirculated exhaust gas to be made proportional to that of the sucked intake air. Also, EGR can be cut off in any desired region (such as the high-load, high-speed operation) by means of the negative pressure supplied from the venturi port. Thus, the sticking of the EGR control valve and other troubles that might be caused by heat can successfully be prevented.

MODIFICATIONS

Figure 3:
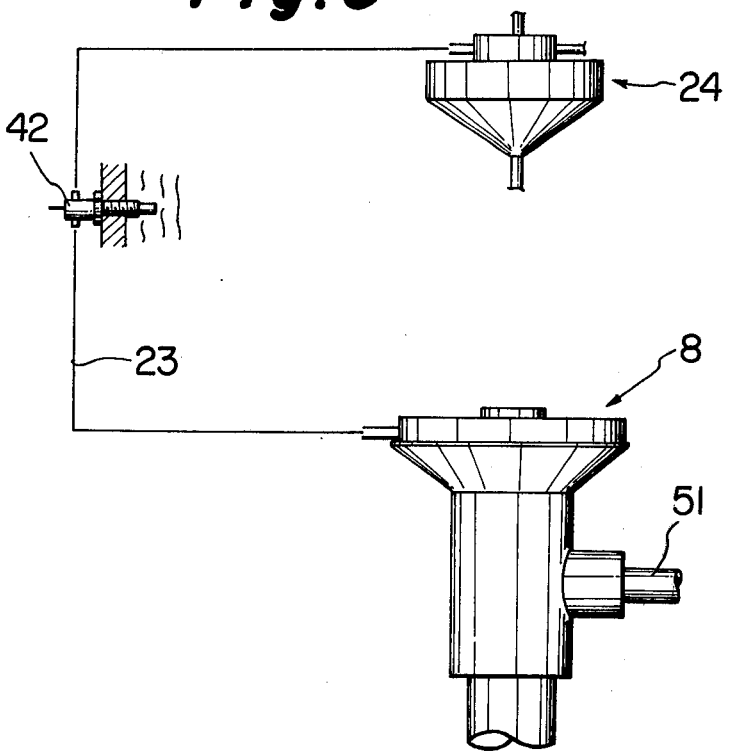
FIG. 3 is a schematic system diagram of another embodiment of this invention.

A device that is capable of cutting off EGR at low temperature, which is constructed as illustrated in FIG. 3, may be added to the above-described embodiment of FIGS. 1 and 2. More particularly, a thermostatic change-over valve 42, that functions so as to open the negative control pressure passage 23 to the atmosphere when the temperature of the engine cooling water falls below a predetermined level, is provided in the negative control pressure passage 23 leading to the EGR control valve 8. The object of thermostatic valve 42 is to prevent the lowering of ignitability by cutting off EGR when the engine is cold.

Figure 4:
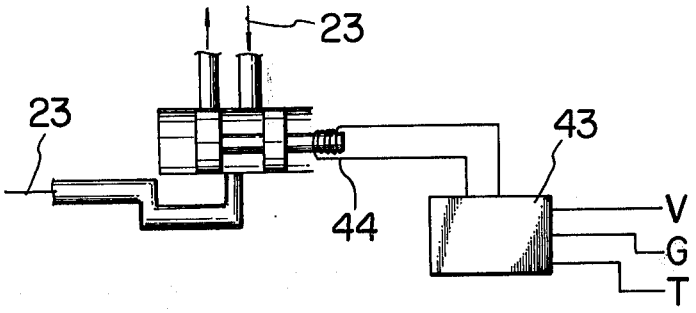
FIG. 4 is a schematic system diagram of a further variation of the invention.

FIG. 4 shows another embodiment of the thermostatic change-over valve 42 shown in FIG. 3. Various factors, such as vehicle velocity V, gear shift G and engine temperature T, which indicate the operating condition of the engine are fed in a controller 43 for computation. When the operating condition reaches a predetermined condition, a signal to cut off EGR is transmitted from said controller 43, whereby an electromagnetic change-over valve 44 is actuated to open the negative control pressure passage 23 to the atmosphere.

As is evident from the above, this invention improves the durability of the EGR control valve, effectively reduces nitrogen oxides in the exhaust gas without impairing the drivability of the vehicle, and contributes to improve the fuel economy.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property of privilege is claimed are defined as follows:

1. An apparatus for recirculating exhaust gases, comprising:

exhaust gas recirculating passage means for providing communication between the intake and exhaust passages of an internal combustion engine, said passage means having the inlet end thereof communicating with said exhaust passage, and the outlet end of said passage means communicating with said intake passage at a location disposed downstream of the throttle plate;

constriction means provided in said passage means;

control valve means for controlling the recirculation of exhaust gases through said passage means, said control valve means including a movable control valve provided in said passage means downstream of said constriction means, said control valve means also including actuator means for controlling the movement of said control valve between opened and closed positions, said actuator means including a fluid pressure chamber having a movable actuator member associated therewith and interconnected to said control valve;

a negative control pressure passage connected between a port in the intake passage and the fluid pressure chamber for introducing negative control pressure to the control valve means;

pressure chamber means interposed between said constriction means and said control valve, said pressure chamber means having a pressure therein which is substantially equal to atmospheric pressure when the control valve is opened and to that in the exhaust passage when the control valve is closed;

first operating valve means for opening said negative control pressure passage to the atmosphere when the pressure in said chamber means becomes substantially atmospheric and the rate of exhaust gas recirculation is substantially proportional to the rate of intake air flow;

said first operating valve means including a movable valve element associated with a controlling chamber, a first controlling passage providing communication between said pressure chamber means and said controlling chamber, a second controlling passageway providing communication between the negative control pressure passage and the atmosphere, and said valve element when in a closed position closing off said second controlling passageway; and second operating valve means, responsive to the amount of sucked air flowing through the intake passage, for opening said negative control pressure passage to the atmosphere when the pressure in the intake passage exceeds a predetermined negative pressure level;

said second operating valve means being independent of said first operating valve means and including a movable valve member associated with a control chamber, a first control passage communicating between said control chamber and said intake passage, and a second control passage providing communication between said negative control pressure passage and the atmosphere, said movable valve member coacting with said second control passage for controlling the flow therethrough.

2. An apparatus according to claim 1, wherein said negative control pressure passage provides continuous communication between the intake passage and the fluid pressure chamber associated with said actuator means, said negative control pressure passage having a flow constriction formed therein, and wherein said second controlling passageway and said second control passage both communicate with said negative control pressure passage at a location disposed between said last-mentioned constriction and said fluid chamber.

3. An apparatus according to claim 1, wherein the port in the intake passage is disposed closely adjacent the edge of the throttle plate so that said port is located upstream of the throttle plate when same is substantially closed, whereas said port is located downstream of the throttle plate when same is substantially opened.

4. An apparatus according to claim 3, whererin the intake passage has a venturi therein located upstream of the throttle plate, and said first control passage communicating with said intake passage at said venturi.

5. An apparatus according to claim 1, wherein said first operating valve means includes a first flexible diaphragm which sealingly isolates said controlling chamber from said second controlling passageway, said valve element being mounted on said first diaphragm and movable therewith, and spring means for normally urging said valve element into an open position permitting flow through said second controlling passageway;

and wherein said second operating valve means includes a second flexible diaphragm sealingly isolating said control chamber from said second control passage, said valve member being mounted on said second diaphragm and movable therewith, and spring means coacting with said valve member for normally urging same into a closed position wherein it prevents flow through said second control passage.

6. An apparatus according to claim 5, wherein said second controlling passageway includes an intermediate chamber which is disposed on the opposite side of said first diaphragm from said controlling chamber, said second controlling passageway also including a passageway portion providing communication between said intermediate chamber and said negative control pressure passage, whereby movement of said valve element into a closed position causes closing off of said passageway portion, and said first diaphragm being oriented with said controlling chamber located adjacent the lower side thereof so that any moisture which condenses within said controlling chamber does not collect on said first diaphragm.

7. An apparatus according to claim 1, including changeover valve means associated with said negative control pressure passage for opening same to the atmosphere when a predetermined engine operating condition is detected.

8. An apparatus according to claim 6, wherein said port communicates with said intake passage directly adjacent said throttle plate so that said port is located upstream of the throttle plate when same is substantially closed and so that said port is located downstream of the throttle plate when same is substantially opened, and wherein said intake passage has a venturi located therein upstream of said throttle plate, and said first control passage communicating with said intake passage at said venturi.

* * * * *